US005131470A

United States Patent [19]

Miszewski et al.

[11] Patent Number: 5,131,470

[45] Date of Patent: Jul. 21, 1992

[54] SHOCK ENERGY ABSORBER INCLUDING COLLAPSIBLE ENERGY ABSORBING ELEMENT AND BREAK UP OF TENSILE CONNECTION

[75] Inventors: Antoni K. L. Miszewski, Missouri City; Klaus B. Huber, Sugar Land, both of Tex.

[73] Assignee: Schulumberger Technology Corporation, Houston, Tex.

[21] Appl. No.: 618,422

[22] Filed: Nov. 27, 1990

[51] Int. Cl.[5] ..... E21B 43/117; F16F 7/12

[52] U.S. Cl. ..... 166/297; 166/55; 175/4.52; 175/321; 188/377

[58] Field of Search ..... 166/55, 55.1, 297, 298; 175/4.52, 321; 188/377, 371

[56] References Cited

U.S. PATENT DOCUMENTS

| | | | |
|---|---|---|---|
| 3,208,179 | 9/1965 | Hrebicek . | |
| 3,438,304 | 4/1969 | Sautier et al. . | |
| 3,622,060 | 11/1971 | Gussalli | 227/8 |
| 3,871,193 | 3/1975 | Young | 175/321 X |
| 4,067,405 | 1/1978 | Bassinger | 175/321 |
| 4,139,994 | 2/1979 | Alther | 175/321 X |
| 4,227,593 | 10/1980 | Bricmont et al. | 188/377 |
| 4,233,902 | 11/1980 | Hartley et al. | 102/41 |
| 4,434,927 | 3/1984 | Butler et al. | 227/9 |
| 4,498,548 | 2/1985 | Teng | 175/321 X |
| 4,612,429 | 9/1986 | Milianowicz | 200/288 |
| 4,616.782 | 10/1986 | Marietta et al. | 239/752 |
| 4,664,034 | 5/1987 | Christian | 102/457 |
| 4,667,884 | 5/1987 | Braziel | 239/590 |
| 4,674,354 | 6/1987 | Brand | 74/492 |
| 4,693,317 | 9/1987 | Edwards et al. | 166/378 |
| 4,698,470 | 10/1987 | Milianowicz | 200/288 |
| 4,711,481 | 12/1987 | Krage et al. | 188/377 X |
| 4,785,922 | 11/1988 | Kiehart | 188/316 |
| 4,821,620 | 4/1989 | Cartee et al. | 89/36.02 |
| 4,880,088 | 11/1989 | De Oliveria | 188/377 |
| 4,898,244 | 2/1990 | Schneider et al. | 166/297 |
| 4,905,359 | 3/1990 | Wesson et al. | 166/55 |

OTHER PUBLICATIONS

NASA Tech Briefs, Jun. 1990, "Crushable Aluminum Honeycomb".

"New single event energy absorbers out-perform hydraulics elastomers" by Energy Kinetics, copyright 1989.

*Primary Examiner*—William P. Neuder

*Attorney, Agent, or Firm*—Henry N. Garrana; John H. Bouchard

[57] ABSTRACT

A shock absorber is adapted to be disposed within a perforating gun string or within the tubing string above the perforating gun and includes an energy absorbing element adapted to absorb and store mechanical energy during detonation of the perforating gun and to permanently deform in response to the storage of the mechanical energy, the stored energy being released in the form of heat, and not in the form of kinetic energy. Therefore, following absorption of the mechanical energy by the shock absorber, no further expansion of the shock absorber is experienced. The shock absorber includes an inner housing, an outer hosuing, a connection for interconnecting the inner and outer housing, and a break up charge for breaking the connection and releasing the inner housing from the outer housing when the perforating gun is detonated whereby the shock absorber is as strong as the tubing string before the connection is broken and is flexible after the connection is broken. The energy absorbing element may be a damping coil or it may be a honeycomb. The damping coil and honeycomb energy absorbing elements permanently deform when mechanical energy is absorbed; therefore, the stored mechanical energy is subsequently released in the form of heat and not in the form of kinetic energy.

22 Claims, 5 Drawing Sheets

FIG.2a(1)

FIG. 2b
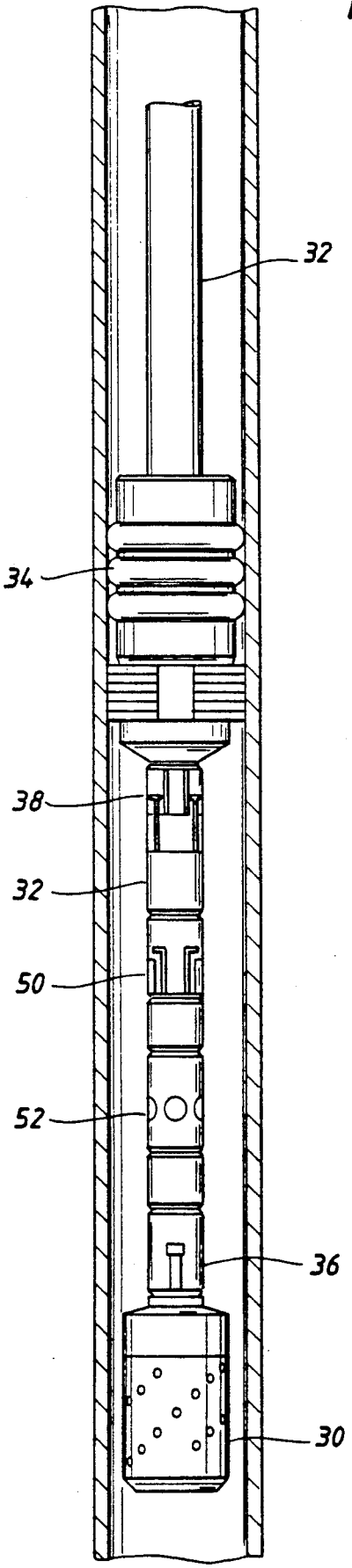
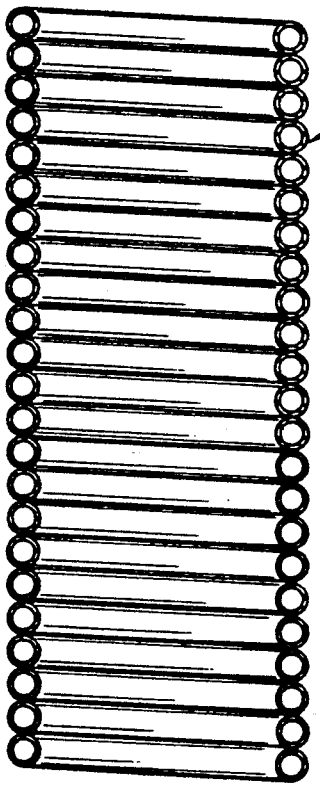
FIG. 3

FIG. 4
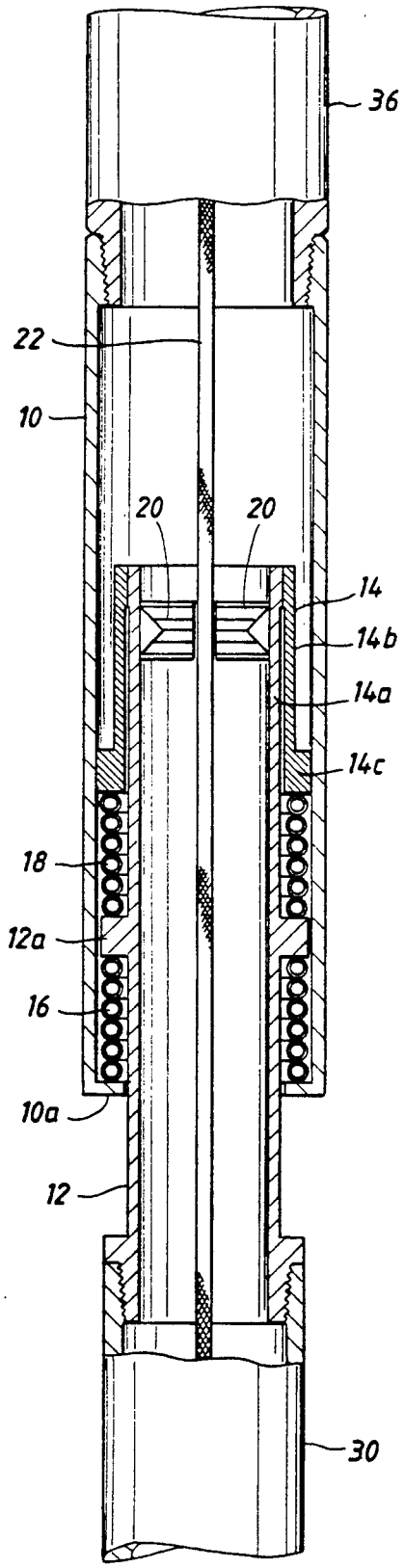
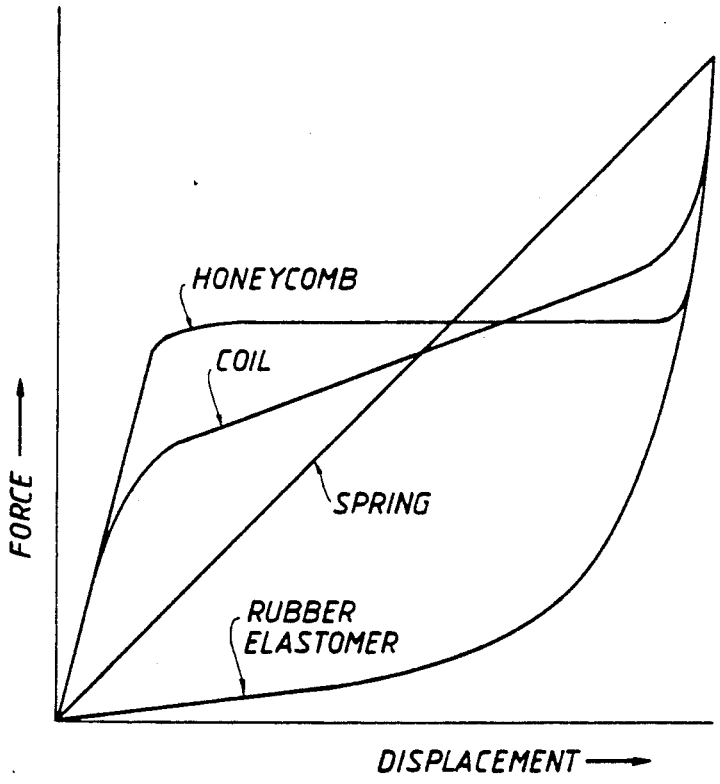
FIG. 7

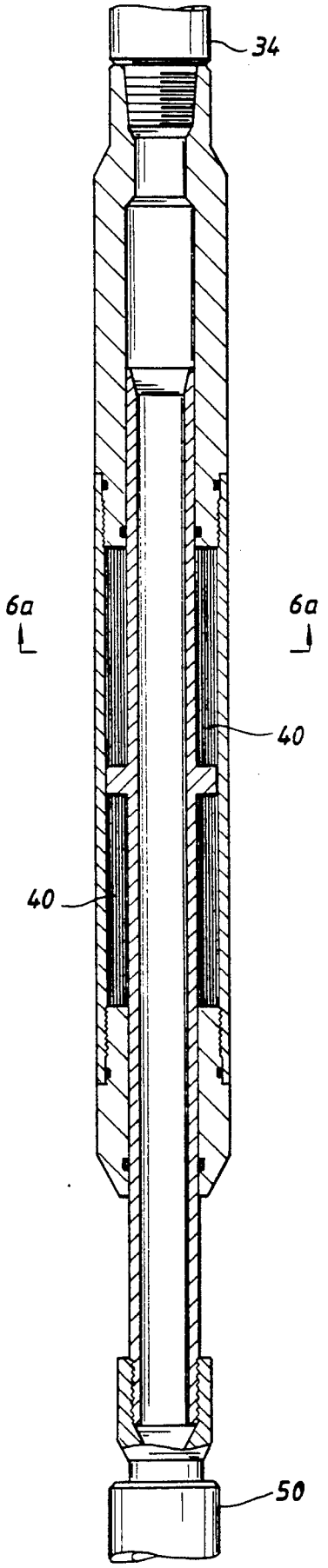
FIG. 6
FIG. 6a
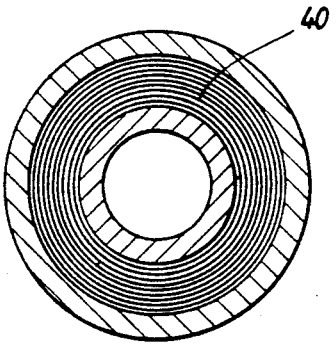

SHOCK ENERGY ABSORBER INCLUDING COLLAPSIBLE ENERGY ABSORBING ELEMENT AND BREAK UP OF TENSILE CONNECTION

BACKGROUND OF THE INVENTION

The subject matter of the present invention relates to a shock absorber for a perforating gun, and more particularly, to a shock absorber incorporated in a perforating gun string which includes a collapsible energy absorbing element adapted to permanently deform when absorbing shock.

Perforating guns are adapted to be disposed in a wellbore for perforating a formation. Well fluids flow from the perforated formation. When the perforating gun fires, a shock is received in the tubing string above the perforating gun. A shock absorber is usually incorporated in the tubing string above the perforating gun for absorbing the shock. The shock absorber usually includes a spring which stores mechanical energy by compression in response to the shock and releases the mechanical energy by expansion following compression over a longer period of time such that the force exerted is reduced. Although this configuration absorbs mechanical energy associated with the shock, attempts to improve this shock absorber have focused on achieving a smoother release of the mechanical energy from the spring coil shock absorber system following storage of the mechanical energy. However, the problem associated with the release of the mechanical energy could be eliminated entirely if the absorbing element in the shock absorber did not expand following compression but, instead, released the stored energy in a different form, such as heat.

SUMMARY OF THE INVENTION

Accordingly, it is an object of the present invention to provide a new "single event" shock absorber which is adapted to be disposed in a tubing string above a firing head of a perforating gun.

It is a further object of the present invention to provide a new "single event" shock absorber which is also adapted to be disposed below a firing head of a perforating gun, or within the perforating gun string itself, in addition to being adapted for disposition within the tubing string above the firing head, thereby providing full bore access to the firing head.

It is a further object of the present invention to provide a new "single event" shock absorber for use in connection with a perforating gun, the "single event" shock absorber absorbing mechanical energy in response to detonation of the perforating gun; however, it subsequently releases the absorbed mechanical energy in the form of heat, and not in the form of kinetic energy.

It is a further object of the present invention to provide the new single event shock absorber for use in connection with a perforating gun including a collapsible mechanical energy absorbing element, the energy absorbing element collapsing during absorption of the mechanical energy, the absorbed mechanical energy being subsequently released in the form of heat, the collapse of the energy absorbing element preventing a subsequent release of the absorbed mechanical energy in the form of kinetic energy.

It is a further object of the present invention to provide the new single event shock absorber for use in connection with a perforating gun disposed on a tubing string, the shock absorber including a collapsible mechanical energy absorbing element and a break up charge, the break up charge breaking a connection within the energy absorbing element when the perforating gun is being detonated but maintaining the connection within the energy absorbing element before detonation of the perforating gun, whereby the shock absorber is as strong as the tubing string before the breaking of the connection and the detonation of the perforating gun but is flexible for absorbing shock after the breaking of the connection within the energy absorbing element.

It is a further object of the present invention to provide a shock absorber adapted for absorbing mechanical energy including an inner housing, an outer housing, a connection between the inner and outer housings, and a break up charge adapted for producing a jet and breaking the connection between the inner and outer housings, the shock absorber appearing to be a string of full tensile strength before the connection between the inner and outer housings is broken and absorbing the mechanical energy thereby functioning as a flexible shock absorber after the connection between the inner and outer housings is broken.

It is a further object of the present invention to provide the new shock absorber for use in connection with a perforating gun, the shock absorber including a collapsible mechanical energy absorbing element, the energy absorbing element being a collapsible honeycomb, the honeycomb having a plurality of hollow interiors thereby allowing the honeycomb to collapse during absorption of the mechanical energy, the absorbed mechanical energy being released in the form of heat and not in the form of kinetic energy.

It is a further object of the present invention to provide the new shock absorber for use in connection with a perforating gun, the shock absorber including a collapsible mechanical energy absorbing element, the energy absorbing element being a collapsible damping coil, the coil having a hollow interior thereby allowing the coil to collapse during absorption of the mechanical energy, the absorbed mechanical energy being released in the form of heat and not in the form of kinetic energy.

These and other objects of the present invention are accomplished and fulfilled by providing a shock absorber which is adapted to be incorporated either within a tubing string above a firing head of the perforating gun, or below the firing head and within the perforating gun string itself. The shock absorber includes an inner housing, an outer housing, a connection between the inner and outer housings, a collapsible energy absorbing element, such as a collapsible honeycomb or a collapsible damping coil, and a break up charge connected to a detonating cord which is further connected to the perforating gun, the break up charge being responsive to a detonation wave in the detonating cord for producing a jet and breaking the connection between the inner and outer housing, the energy absorbing element absorbing mechanical energy when the connection between the inner and outer housing is broken by the break up charge and permanently deforming in response to the absorption of the mechanical energy. The energy absorbing element has a hollow interior, and the material from which the absorbing element is made is designed to collapse and permanently deform in response to absorption of the mechanical energy. When the perforating gun detonates, the mechanical energy absorbing element collapses and permanently deforms thereby absorbing the mechanical energy released during the detonation. Subsequent release of the mechanical energy takes place in the form of heat, and not in the form of kinetic energy.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 2*a*(1) illustrates the shock absorber of FIG. 2*a* in greater detail;

FIG. 2*b* illustrates a perforating gun including a firing head disposed on an end of a tubing string, and an energy absorbing element shock absorber disposed above the firing head of the perforating gun;

FIG. 3 illustrates an energy absorbing element adapted to be disposed within the shock absorber;

FIG. 4 illustrates a novel shock absorber in accordance with the present invention adapted to be incorporated below a perforating gun firing head and within a perforating gun string, the shock absorber including a damping coil mechanical energy absorbing element; and FIGS. 4, 5*a*, 5*c* illustrate the shock absorber of FIG. 4, adapted to be incorporated within a perforating gun string, disposed in a shock absorbing condition existing before, during and after detonation of the perforating gun;

FIG. 6 illustrates a further novel shock absorber in accordance with another embodiment of the present invention adapted to be incorporated above a perforating gun firing head and within a tubing string, the shock absorber including a honeycomb mechanical energy absorbing element;

FIG. 6*a* illustrates a cross-section of the shock absorber of FIG. 6, taken along section lines 6*a*—6*a* of FIG. 6; and FIG. 7 illustrates a plurality of graphs of force vs displacement for various types of energy absorbing shock absorbers.

DETAILED DESCRIPTION OF THE PREFERRED EMBODIMENT

Perforating guns are utilized in well logging for perforating a formation traversed by a borehole, well fluids being produced from the perforated formation. The perforating guns contain shape charges; when the shape charges detonate, the formation is perforated; however, a shock is generated from the gun, the shock propagating up the guns string. In order to reduce the severity of the shock, shock absorbers are usually incorporated within the tubing string above the perforating gun. All such shock absorbers to date absorb mechanical energy and subsequently release the mechanical energy in the form of kinetic energy. It has been important to carefully analyze the release of mechanical energy since an abrupt release of the mechanical energy may produce still another shock.

Typical prior art shock absorbers store mechanical energy during absorption of a shock and subsequently release the mechanical energy in the form of kinetic energy. For example, in a standard spring shock absorber, the mechanical energy is stored during compression of the spring and is released in the form of kinetic energy during expansion of the spring. Shock severity may be reduced by storage of the input energy and its release in a "smoother" form over a longer period of time.

Figure 1:
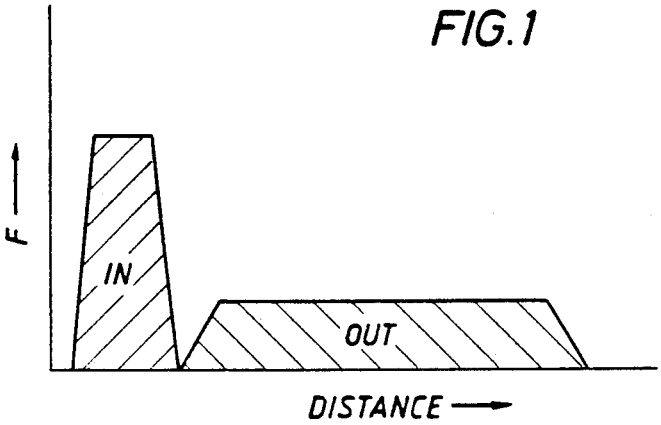
FIG. 1 illustrates an optimum theory associated with shock absorption in a perforating gun string.
Figure 1:
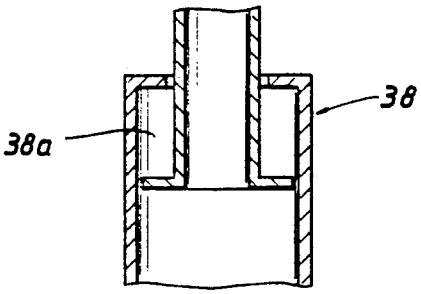

For example, referring to FIG. 1, the energy input "IN" to a shock absorber system is shown by the first energy pulse, and the energy released "OUT" from the shock absorber system is shown by the second energy pulse. Note that the second energy pulse "OUT" illustrates a relatively flat amplitude pulse, the amplitude of the second pulse being smaller than the amplitude of the first pulse thereby indicating a release of the mechanical energy in a smoother form over a longer period of time.

Shock absorbers of the prior art released their stored mechanical energy in the form of kinetic energy. Improvements to the shock absorbers of the prior art have primarily involved generating a smoother release of the stored mechanical energy in the form of kinetic energy. However, the shock absorber of the present invention utilizes a different principle of operation; that is, it is a "single event" shock absorber, one which receives mechanical energy during energy absorption but does not subsequently release the stored mechanical energy in the form of kinetic energy; instead, it releases the stored mechanical energy in the form of heat. This permits the shock absorber to be incorporated within the perforating gun string as well as within the tubing string above the perforating gun.

Figure 2A:
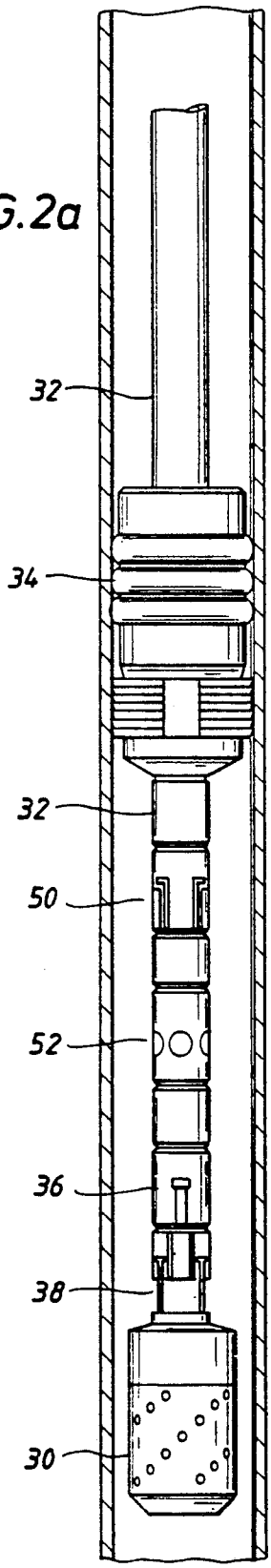
FIG. 2*a* illustrates a perforating gun including a firing head disposed on an end of a tubing string, and an energy absorbing element shock absorber disposed below the firing head within the perforating gun.

Referring to FIGS. 2*a* and 2*a*(1), a shock absorber in accordance with the present invention is disposed below a firing head of a perforating gun and within the perforating gun string.

In FIG. 2*a*, a perforating gun 30 is connected to one end of a tubing string 32 in a borehole and an isolation packer 34 is disposed within the tubing string 32 above the perforating gun 30; when the packer 34 is set, an interval between the tubing string and a wall of the borehole above the packer is isolated from an interval between the tubing and the wall of the borehole below the packer. A gun release sub 50, a debris circulating sub 52, a drop bar firing head assembly 36, and a "single event" shock absorber assembly 38 are disposed between the perforating gun 30 and the isolation packer 34 on the tubing 32. The firing head assembly 36 is disposed above the perforating gun 30, and the "single event" shock absorber assembly 38, in accordance with the present invention, is disposed below the firing head 36 and within the perforating gun 30 (and not within the tubing string above the firing head). In FIG. 2*a*(1), the shock absorber assembly 38 contains an energy absorbing element (not shown) disposed within a space 38*a* of the shock absorber 38, the energy absorbing element storing mechanical energy during shock absorption, and subsequently releasing the stored energy in the form of heat (not kinetic energy). As a result, since the shock absorber 38 is not located above the firing head 36 within the tubing string 32, fullbore access to the firing head 36 is available to a user at the well surface.

Referring to FIG. 2*b*, a shock absorber in accordance with the present invention is disposed above a firing head of a perforating gun and within the tubing string.

In FIG. 2*b*, a perforating gun 30 is connected to one end of a tubing string 32 in a borehole and an isolation packer 34 is disposed within the tubing string 32 above the perforating gun 30; when the packer 34 is set, an interval between the tubing string and a wall of the borehole above the packer is isolated from an interval between the tubing and the wall of the borehole below the packer. A "single event" shock absorber 38, a gun release sub 50, a debris circulating sub 52, and a drop bar firing head assembly 36 are disposed between the packer 34 and the perforating gun 30 on the tubing 32. The "single event" shock absorber assembly 38 of the present invention is disposed above the firing head 36 of perforating gun 30 and between the gun release sub 50 and the packer 34 within the tubing 32. Since the shock absorber 38 is a "single event" type, it can be equally effective, relative to the shock absorber of FIG. 2*a*, in absorbing shock when disposed above the firing head 36 within the tubing string 32. The shock absorber of FIG. 2*b* also includes a space 38*a* in which a "single event" energy absorbing element is disposed. The term "single event" connotes the absorption of mechanical energy resultant from a shock produced during detonation of the perforating gun, but not the release of the stored mechanical energy in the form of kinetic energy.

Referring to FIG. 3, one embodiment of a "single event" energy absorbing element, adapted to be disposed within space 38*a* of FIG. 2*a*(1), is illustrated. In FIG. 3, the energy absorbing element comprises a hollow damping coil 18. When a compressive force is applied to both of the ends of the hollow coil 18, the hollow coil 18 will permanently deform. The coil 18 will not expand following compression; therefore, the stored mechanical energy is not subsequently released in the form of kinetic energy; rather, the stored energy will be released in the form of heat.

Referring to FIG. 4, a detailed construction of the shock absorber 38 of FIG. 2*a*, designed to be fit below the firing head assembly 36 and within the perforating gun 30, is illustrated.

In FIG. 4, the shock absorber 38 of FIG. 2*a*, in accordance with one embodiment of the present invention, comprises an outer housing 10 having one end including a first inwardly disposed transverse member 10*a*; an inner housing 12 which includes a second transverse member 12*a* transversely disposed with respect to the inner housing 12 and having a surface in contact with an inner surface of the outer housing 10; a joining member 14 which joins the outer housing 10 to the inner housing 12, the joining member 14 including a inner piece 14*a* forming an integral part of the inner housing 12, an outer piece 14*b* having one end integrally joined to the inner piece 14*a*, and a third transverse member 14*c* integrally joined to the other end of the outer piece 14*b*, the third transverse member 14*c* contacting an inner surface of the outer housing 10. A first space is defined between the inner housing 12 and the outer housing 10 by the first inwardly disposed transverse member 10*a* of the outer housing 10 and the second transverse member 12*a* of the inner housing 12; a first energy absorbing element 16, otherwise termed a damping coil 16, is disposed within the first space. A second space is defined between the inner housing 12 and the outer housing 10 by the second transverse member 12*a* of the inner housing 12 and the third transverse member 14*c* of the joining member 14; a second energy absorbing element, or damping coil, 18 is disposed within the second space. The first and second damping coils 16 and 18 may each be made of aluminum or stainless steel. Each damping coil 16 and 18 has a hollow interior such that the damping coil will collapse and permanently deform when a compressive force of a predetermined magnitude is applied to the coil.

A break up shape charge 20 is disposed within the inner housing 12, and a detonating cord 22 passes through the center of the break up charge, 20. As will be more apparent with reference to FIGS. 5*a*–5*b*, the breakup shape charge 20 detonates when a detonation wave propagates along the detonating cord 22 and through the shape charge 20, the shape charge 20 severing the inner piece 14*a* of the joining member 14 into two parts thereby separating the inner housing 12 from the outer housing 10. Before the inner housing 12 is separated from the outer housing 10 by the shape charge 20, the shock absorber 38 is as strong as the tubing string 32; however, after the inner housing 12 is separated from the outer housing 10 by the break up shape charge 20, the shock absorber 38 is as flexible as any other shock absorber and therefore functions as a shock absorber.

A functional description of the shock absorber 38 of FIGS. 2*a*, 2*a*(1) and FIG. 4 will be set forth in the following paragraphs with reference to FIGS. 4, 5*a* and 5*b* of the drawings.

Figure 5A:
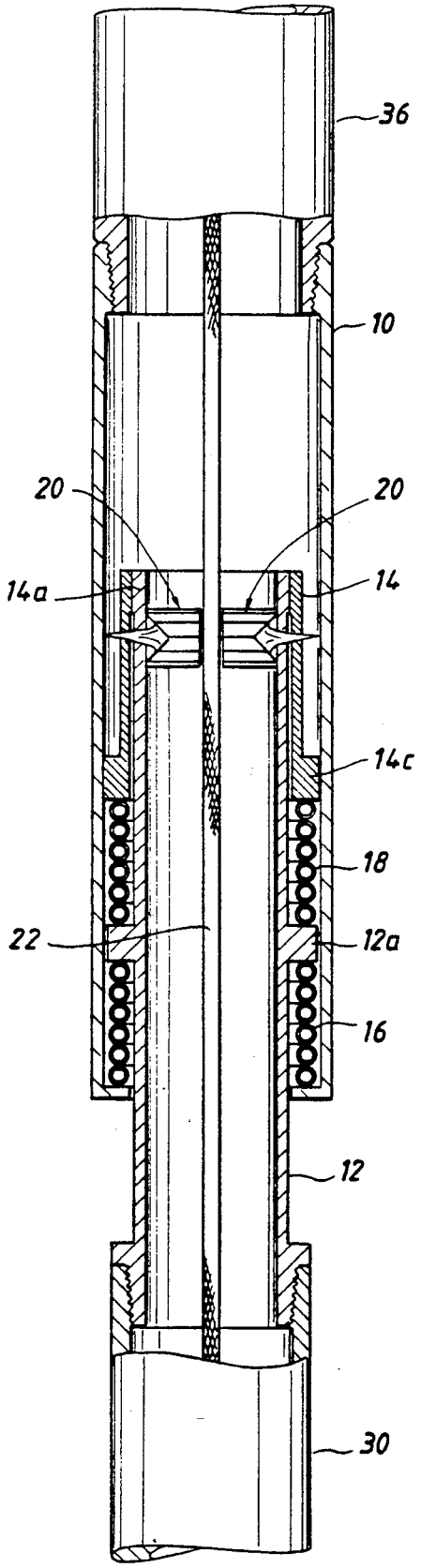
Figure 5B:
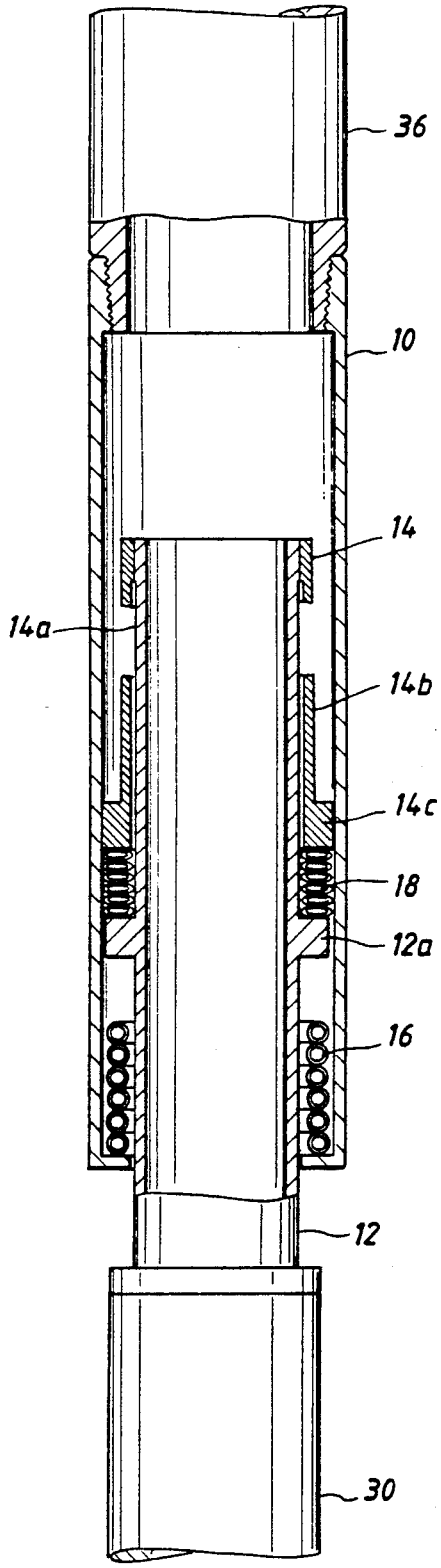

In FIGS. 4, 5*a*, 5*b*, the shock absorber is incorporated below firing head 36 within a perforating gun string. The perforating gun 30 includes a plurality of shape charges. In FIG. 4, the shock absorber is shown before detonation of the shape charges disposed within the perforating gun; in FIG. 5*a*, the shock absorber is shown during detonation of the charges; and, in FIG. 5*b*, the shock absorber is shown after detonation of the perforating gun charges.

In FIG. 4, the shock absorber is shown undisturbed, since a detonation wave has not yet propagated along detonating cord 22, and none of the shape charges of the perforating gun have detonated.

In FIG. 5*a*, a detonation wave propagates along detonating cord 22 indicating that the plurality of shape charges in the perforating gun are either detonating or are about to detonate. When the detonation wave passes through the center of the break up charge 20 in FIG. 5*b*, the charge 20 cuts the joining member 14 into two pieces (e.g., severs the inner piece 14*a* into two pieces) thereby separating the inner housing 12 from the outer housing 10. In FIG. 5*a*, the breakup charge 20 is shown cutting the joining member 14 into two pieces, but the shock from the detonation of the perforation gun has not yet been received.

In FIG. 5*b*, the joining member 14 has been cut, the inner piece 14*a* being shown as separated from the outer piece 14*b* of the joining member 14. As a result, inner housing 12 is separated from outer housing 10. In addition, a shock from the detonated perforating gun has been received, the shock causing the inner housing 12 to move upwardly in FIG. 5*b* relative to the outer housing 10. The second transverse member 12*a* of the inner housing 12 moves toward the third transverse member 14c of the joining member 14 thereby crushing the second damping coil 18 disposed within the second space. As a result, the second damping coil 18 has collapsed and is now permanently deformed. Although mechanical energy was stored in the damping coil 18 during compression, since the damping coil 18 has collapsed and is permanently deformed, no expansion of the coil 18 will occur; therefore, the mechanical energy is not released in the form of kinetic energy; rather, it is released in the form of heat.

Referring to FIGS. 6 and 6a, a detailed construction of the shock absorber 38 of FIG. 2b, designed to be fit above the firing head assembly 36 within the tubing string 32, is illustrated.

While the shock absorber 38 of FIGS. 4, 5a, 5b was designed to fit below the firing head 36 and within the perforating gun 30, the shock absorber 38 of FIG. 6 is designed to fit within the tubing string 32 above the firing head 36. The only other significant difference between the shock absorber 38 of FIGS. 4, 5a and 5b and the shock absorber 38 of FIG. 6 is the specific structure of the energy absorbing element adapted to fit within space 38a of FIG. 2a(1). Whereas the damping coil 18 of FIG. 4 was the energy absorbing element used in connection with the shock absorber of FIGS. 4, 5a and 5b, a corrugated honeycomb 40 is the energy absorbing element used in connection with the shock absorber of FIG. 6.

FIG. 6a illustrates the cross-sectional structure of the honeycomb 40 of FIG. 6, FIG. 6a being a cross section of the shock absorber 30 of FIG. 6, taken along section lines 6a—6a of FIG. 6. In FIG. 6a, note the "corrugated" structure of the honeycomb energy absorbing element 40 of FIG. 6. In fact, there are a plurality of layers of the corrugated structure 40 in FIG. 6a, each corrugated layer being disposed on top of its adjacent corrugated layer, the plurality of corrugated layers 40 collectively comprising the honeycomb energy absorbing element adapted to fit within space 38a of the shock absorber 38 of FIG. 2b. When the perforating gun charges detonate, the honeycomb 40 energy absorbing element absorbs mechanical energy and permanently deforms, the deformation being the same as that illustrated in FIG. 5b. Mechanical energy is absorbed and stored during the deformation of honeycomb 40; however, the stored energy is released in the form of heat, and not in the form of kinetic energy.

Referring to FIG. 7, a plot of force vs. displacement for various types of energy absorbing elements disposed in a shock absorber is illustrated, the energy absorbed by a particular energy absorbing element being equal to the area under its curve. In FIG. 7, a prior art rubber elastomer energy absorbing element is illustrated as having the worst energy absorption, since the area under its curve is the least as compared to a spring element, a damping coil element and a honeycomb element. The honeycomb energy absorbing element 40 possesses the best energy absorption since it has the largest area under its curve and exhibits the lowest reaction force for a given energy absorption. The damping coil energy absorbing element 18 possesses the next best energy absorption.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A shock absorber adapted to include a detonating cord for receiving and absorbing mechanical energy resultant from a shock, a detonation wave propagating in said detonating cord, comprising:
   an outer housing;
   an inner housing:
   connection means for connecting the inner housing to the outer housing;
   break up means responsive to said detonation wave propagating in said detonating cord for breaking said connection means, the inner housing being released from said outer housing when the connection means is broken; and
   collapsible energy absorbing element means responsive to the mechanical energy for absorbing the mechanical energy and permanently deforming, the energy absorbing element means releasing the absorbed mechanical energy in the form of heat and not in the form of kinetic energy.

2. The shock absorber of claim 1, wherein the collapsible energy absorbing element means absorbs the mechanical energy and permanently deforms when the inner housing is released form the outer housing in response to the breaking of said connection means.

3. The shock absorber of claim 1, wherein said collapsible energy absorbing element means comprises a damping coil.

4. The shock absorber of claim 1, wherein said collapsible energy absorbing element means comprises a honeycomb.

5. A shock absorber for receiving and absorbing mechanical energy resultant from a shock, comprising:
   an outer housing;
   an inner housing:
   connection means for connecting the inner housing to the outer housing; and
   break up means for breaking said connection means, the inner housing being released from said outer housing when the connection means is broken.

6. The shock absorber of claim 2, further comprising: energy absorbing means for absorbing said mechanical energy when the inner housing is released form the outer housing.

7. The shock absorber of claim 6, wherein said energy absorbing means is disposed between the inner housing and the outer housing.

8. The shock absorber of claim 6, wherein said energy absorbing means is collapsible and permanently deforms when absorbing the mechanical energy.

9. The shock absorber of claim 8, wherein said energy absorbing means comprises a damping coil.

10. The shock absorber of claim 8, wherein said energy absorbing means comprises a honeycomb.

11. The shock absorber of claim 8, further comprising a detonating cord disposed within the inner housing, said detonating cord being adapted for conducting a detonation wave, said break up means breaking said connection means when said detonation wave conducts within said detonating cord.

12. A perforating gun including a detonating cord and adapted for detonating and generating mechanical energy in response to a detonation wave propagating through said detonating cord, comprising:
   shock absorber means for absorbing the mechanical energy and releasing the absorbed mechanical energy in the form of heat and not in the form of kinetic energy, said shock absorber means including, an outer housing;

an inner housing:

connection means for connecting the inner housing to the outer housing;

break up means responsive to said detonation wave propagating in said detonating cord for breaking said connection means, the inner housing being released from said outer housing when the connection means is broken; and collapsible energy absorbing element means for absorbing the mechanical energy and permanently deforming during detonation of the perforating gun, the energy absorbing element means releasing the absorbed mechanical energy in the form of heat and not in the form of kinetic energy.

13. The perforating gun of claim 12, wherein the collapsible energy absorbing element means absorbs the mechanical energy and permanently deforms when the inner housing is released from the outer housing in response to the breaking of said connection means.

14. A well apparatus including a tubing string, the tubing string receiving mechanical energy in response to a shock, comprising:

energy absorbing means connected to said tubing string for receiving said mechanical energy and storing the mechanical energy therein, the stored mechanical energy not being subsequently released in the form of kinetic energy, the energy absorbing means including, an outer housing;

an inner housing:

connection means for connecting the inner housing to the outer housing; and break up means for breaking said connection means, the inner housing being released from said outer housing when the connection means is broken.

15. The well apparatus of claim 14, wherein the stored mechanical energy is released in the form of heat.

16. The well apparatus of claim 15, wherein the energy absorbing means further comprises collapsible means disposed between the inner and outer housing for collapsing and permanently deforming when storing the mechanical energy.

17. A method practiced by a shock absorber adapted to be connected to a well apparatus for absorbing shock, the shock absorber including an energy absorbing element, comprising the steps of:

breaking a connection between an outer housing and an inner housing of said shock absorber in response to said shock, the inner housing being released from the outer housing when the connection is broken;

receiving said shock in said energy absorbing element of said shock absorber;

storing mechanical energy associated with said shock in said energy absorbing element; and subsequently releasing the stored energy in the form of heat and not in the form of kinetic energy.

18. The method of claim 17, wherein the well apparatus is a perforating gun.

19. The method of claim 17, wherein the well apparatus is a tubing string.

20. The method of claim 17, wherein the storing step comprises the step of:

permanently deforming said energy absorbing element during the storing step.

21. A tubing string connected to a perforating gun apparatus, the perforating gun apparatus including a detonating cord, a detonation wave propagating through said detonating cord, said perforating gun apparatus adapted for detonating and generating mechanical energy when said detonation wave propagates through said detonating cord, the tubing string comprising:

shock absorber means for absorbing the mechanical energy, the shock absorber means including, an outer housing, an inner housing, connection means for connecting the inner housing to the outer housing, and break up means responsive to said detonation wave propagating in said detonating cord for breaking said connection means, the inner housing being released from said outer housing when the connection means is broken.

22. A perforating gun apparatus including a detonating cord and adapted for detonating and generating mechanical energy, a detonation wave propagating through said detonating cord, comprising:

shock absorber means for absorbing the mechanical energy, the shock absorber means including, an outer housing, an inner housing, connection means for connecting the inner housing to the outer housing, and break up means responsive to said detonation wave propagating in said detonating cord for breaking said connection means, the inner housing being released from said outer housing when the connection means is broken.

* * * * *